US006644411B2

(12) United States Patent
Compton et al.

(10) Patent No.: US 6,644,411 B2
(45) Date of Patent: Nov. 11, 2003

(54) TUBING HANGER WITH FLAPPER VALVE

(75) Inventors: Dewey Craig Compton, Richmond, TX (US); Edwin R. Knerr, Houston, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 09/837,097

(22) Filed: Apr. 18, 2001

(65) Prior Publication Data

US 2002/0153143 A1 Oct. 24, 2002

(51) Int. Cl.[7] ..... E21B 29/12

(52) U.S. Cl. ..... 166/368; 166/348; 166/86.1; 166/332.8

(58) Field of Search ..... 166/368, 348, 166/87.1, 86.1, 321, 332.8, 75.14

(56) References Cited

U.S. PATENT DOCUMENTS

| | | | | | |
|---|---|---|---|---|---|
| 3,065,793 | A | * | 11/1962 | Page | 166/321 |
| 3,071,151 | A | * | 1/1963 | Sizer | 137/496 |
| 3,360,048 | A | | 12/1967 | Watkins | 166/87 |
| 3,375,874 | A | * | 4/1968 | Cherry | 166/114 |
| 4,331,315 | A | * | 5/1982 | Geisow | 166/321 |
| 4,333,526 | A | | 6/1982 | Watkins | 166/87 |
| 4,335,526 | A | | 6/1982 | Smith | 34/229 |
| 4,449,583 | A | | 5/1984 | Lawson | 166/72 |
| 4,601,341 | A | * | 7/1986 | Pringle et al. | 166/321 |
| 4,660,646 | A | * | 4/1987 | Blizzard | 166/321 |
| 4,796,705 | A | * | 1/1989 | Carmody et al. | 166/321 |
| 4,926,945 | A | * | 5/1990 | Pringle et al. | 137/522 |
| 5,044,432 | A | | 9/1991 | Cunningham | 166/87 |
| 5,125,457 | A | * | 6/1992 | Meaders | 137/516.29 |
| 5,137,089 | A | * | 8/1992 | Smith et al. | 166/321 |
| 5,143,158 | A | | 9/1992 | Watkins | 166/344 |
| 5,323,859 | A | | 6/1994 | Smith | |
| 5,687,794 | A | | 11/1997 | Watkins | 166/363 |
| 5,862,864 | A | * | 1/1999 | Whiteford | 166/321 |
| 6,003,605 | A | * | 12/1999 | Dickson et al. | 166/324 |
| 6,196,261 | B1 | * | 3/2001 | Dennistoun | 137/516.25 |
| 6,209,663 | B1 | * | 4/2001 | Hosie | 166/332.8 |
| 6,227,299 | B1 | * | 5/2001 | Dennistoun | 137/515 |
| 6,296,061 | B1 | * | 10/2001 | Leismer | 166/324 |
| 6,352,118 | B1 | * | 3/2002 | Dickson et al. | 166/322 |

OTHER PUBLICATIONS

Halliburton and Otis, In: Completion Products, Second Edition, Chapter 5: Subsurface Safety Equipment, pp. 5–1–5–5 and 5–18, Halliburton Energy Services, Inc., 1997.

* cited by examiner

*Primary Examiner*—Thomas B. Will
*Assistant Examiner*—Thomas A. Beach
(74) *Attorney, Agent, or Firm*—Wendy Buskop; Buskop Law Group, PC

(57) ABSTRACT

A tubing hanger including a tubing hanger body having a tubing string which is adapted to be supported in the bore of the wellhead housing wherein the apparatus comprises a flapper valve disposed in or below the tubing hanger, wherein the valve further comprises a flapper valve having a flapper valve closure member substantially in the form of a concave spherical segment defining an annular valve seat concentric with the tubing for the flapper valve; a flapper plate disposed in the valve chamber for rotatable movement from a valve position in which the flapper plate is removed from the annular valve seat to a valve position in which the flapper plate extends transversely across the flow passage for the flapper valve and forms a sealing engagement with the annular valve seat and the sealing surface is substantially in the form of a convex spherical segment, wherein the convex spherical segment is disposed intermediate between the first and second planar surfaces.

14 Claims, 4 Drawing Sheets

TUBING HANGER WITH FLAPPER VALVE

BACKGROUND OF THE INVENTION

This invention relates generally which includes, among other things, a subsea wellhead housing installed at the ocean floor, a tubing hanger installed in the wellhead housing having a bore above the tubing hanger for suspending the tubing string and a flapper valve installed either in the tubing hanger or below the tubing hanger for hydraulically controlling flow through the tubing hanger or into the tubing hanger.

During the completion of an offshore well, the tubing hangers are typically lowered into supported positions within the wellhead housing through a blowout preventer (BOP) stack installed above the housing. Then, following completion of the well, the BOP stack is replaced by a Christmas tree having suitable valves for controlling the production of well fluids, connecting the tubing hanger to the Christmas tree on one end, and the annulus of the well on the other end.

In most versions of the tree assembly, the tubing hanger has a bore with sealing means, so that the tubing hanger has a fluid barrier between the annulus and the passageway in the tubing hanger. However, during completion of the well, as well as after completion of the well, there may be reasons to communicate between the tubing hanger bore and the annulus to permit fluid circulation between them. The present invention relates to a sealing means that can be installed in a tubing hanger or below a tubing hanging to open and close the tubing hanger passageway.

Subsea tubing hangers having valves for sealing off the passageway of the tubing hanger are shown, for example, in U.S. Pat. Nos. 3,360,048, 4,335,526 and 4,449,583 as well as in U.S. Pat. Nos. 5,687,794, 5,143,158, 5,044,432 and 4,333,526. In most of the patents, however, as well as in other apparatus of this type, the passageways through the tubing hangers are typically controlled by valves which have sealing parts of elastomeric material which may be damaged by extreme heat or other deleterious conditions of the well fluids.

Also, in the valves of certain of these patents, movement of the valves from closed to open positions requires the installation and manipulation of a separate tool which is cumbersome and subject to breaking and not hydraulic manipulation. Furthermore, in most situations, the valves are moved from closed to open positions by springs, which are highly susceptible to malfunction.

None of the valves disclosed appears to focus on the safety aspects of controlling fluid flow through use of a flapper safety valve.

An object of this invention is to provide a safety valve, and in particular a flapper valve in a tubing hanger or below a tubing hanger, which is hydraulically operable for controlling the passageway to minimize the possibility of leakage past the fluid barrier provided by the hanger.

An object of the invention is to provide a safety valve, which is so reliable and inexpensive to install, that the valve assembly has significant environmental advantages, and lower construction costs.

A further object of the invention is to provide a flapper valve either integral in the tubing hanger or below the tubing hanger, which can be operated in a reliable manner, without requiring an additional tool.

SUMMARY OF THE INVENTION

The invention comprises a wellhead housing having a wellhead bore disposed therethrough and at least one casing hanger supported within the wellhead bore for suspending at least one casing string within the well head bore. The invention further comprises a tubing hanger having a tubing hanger passageway adapted to be supported in the bore of a subsea wellhead. The invention includes a flapper valve disposed in the tubing hanger passageway and adapted for opening and closing the tubing hanger. The flapper valve comprises a flapper valve body having a flapper valve closure member substantially in the form of a sealing segment, which can be a concave spherical segment. This sealing segment defines an annular valve seat concentric with the tubing hanger bore. A flapper member is most preferably a planar member, such as a plate which is disposed in the passageway, or in sealing engagement with the passageway, and is capable of rotatable movement from a valve position in which the flapper member is removed from the annular valve seat forming an open valve position to a closed valve position in which the flapper member extends transversely across the flow passage forming a sealing engagement with the annular valve seat. The flapper member further comprises a sealing surface substantially in the form of a convex spherical segment, wherein the convex spherical segment is disposed intermediate between first and second planar surfaces of the valve.

For use in a subsea wellhead having an annulus, further including a wellhead housing having a wellhead bore therethrough and at least one casing hanger supported within the wellhead bore for suspending at least one casing string within the well head bore, apparatus comprising: a tubing hanger including a tubing hanger body having a fluid passageway disposed therethrough connected to an annulus; a flapper valve disposed outside of said tubing hanger in said annulus adapted for opening the fluid passageway in said tubing hanger, said flapper valve having a housing connecting said valve to said tubing hanger, a flapper valve closure member substantially in the form of a segment defining an annular valve seat concentric with said tubing for said flapper valve; a flapper member disposed in said valve chamber for rotatable movement from a valve position in which said flapper plate is removed from said annular valve seat to a valve position in which said flapper member extends transversely across said flow passage and forms a sealing engagement with said annular valve seat thereby preventing flow through said fluid passageway; a sealing surface having a segment disposed intermediate between a first and a second planar surface; and means responsive to pressurized fluid for hydraulically moving the valve member, which is preferably the valve plate, from a closed position to an open position.

Additionally, the invention further comprises means responsive to pressurized fluid from a remote source for hydraulically moving the flapper valve member, such as the valve plate, from a closed position to an open position.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
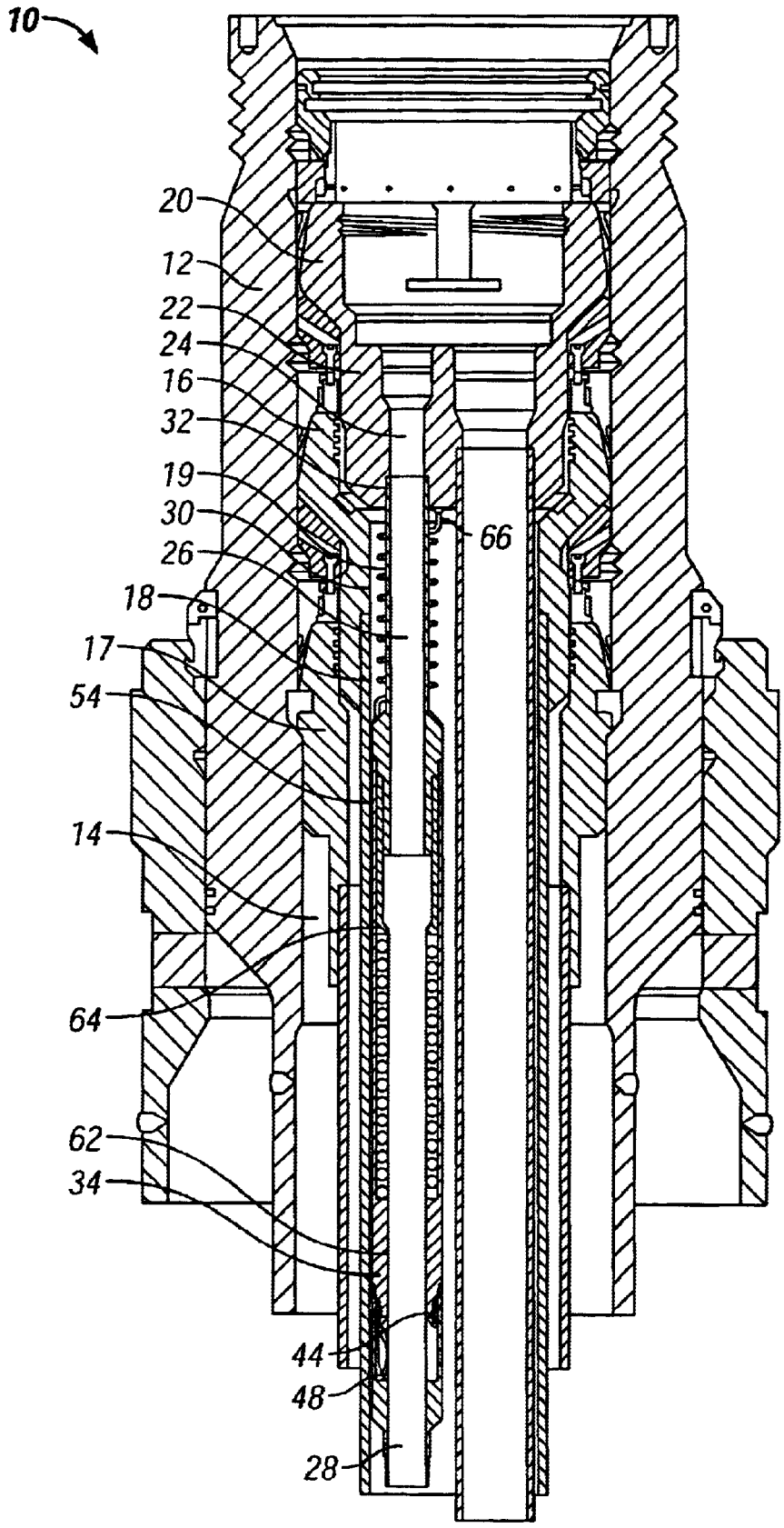
FIG. 1 is a cross section view of a wellhead with tubing hanger with an installed flapper valve.

In its preferred and illustrated embodiment, as shown in FIG. 1, a subsea wellhead 10 has a wellhead housing 12 having a wellhead bore 14. At least one casing hanger 16 is supported within the wellhead bore 14 for suspending at least one casing string 18 within the wellhead bore 14. Also shown in FIG. 1, a second casing hanger 17 is supported within the wellhead bore 14 for suspending a second casing string within the wellhead bore 14.

The casing hanger 16 comprises a tubing hanger 20, which has a tubing hanger body 22, which can be, for example, in the shape of a metal dome received within an opening in the tubing hanger 20. The tubing hanger 20 has an passageway which contains a tubing hanger string 19.

Figure 3:
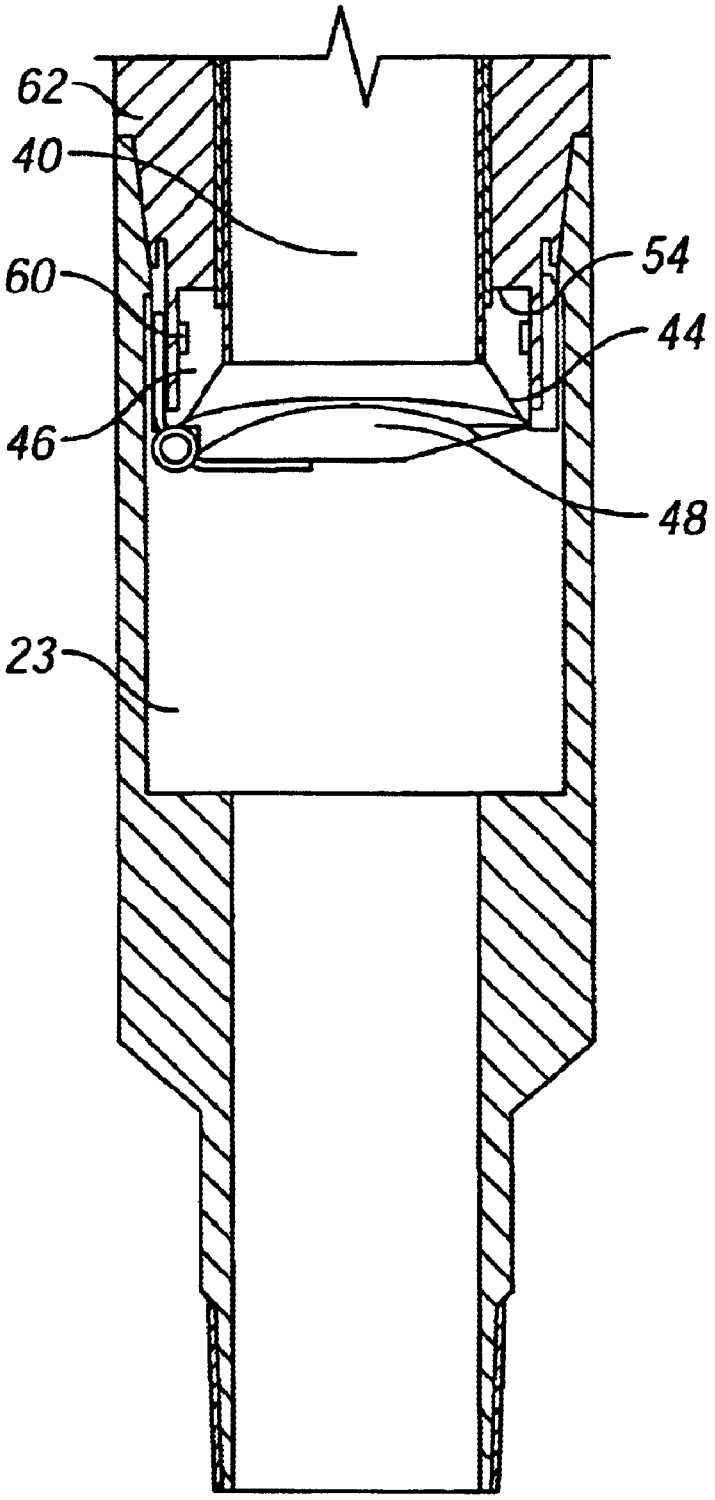
FIG. 3 is a detailed view of a bottom section of a tubing hanger with a flapper valve installed, shown in the closed valve position.

The tubing hanger body 22 has a valve chamber 23, which is shown in FIG. 3, for containing the environmentally friendly, and fluid spill preventing flapper valve 34. It is possible that other types of safety valves may be used in the tubing hanger, but the flapper valve version of the safety valve is the preferred embodiment.

The tubing hanger body 22 has a tubing hanger passageway 24, which has a first section 26 and a second section 28 connecting between the casing hanger 16 and the annulus of the wellhead 30.

Figure 2:
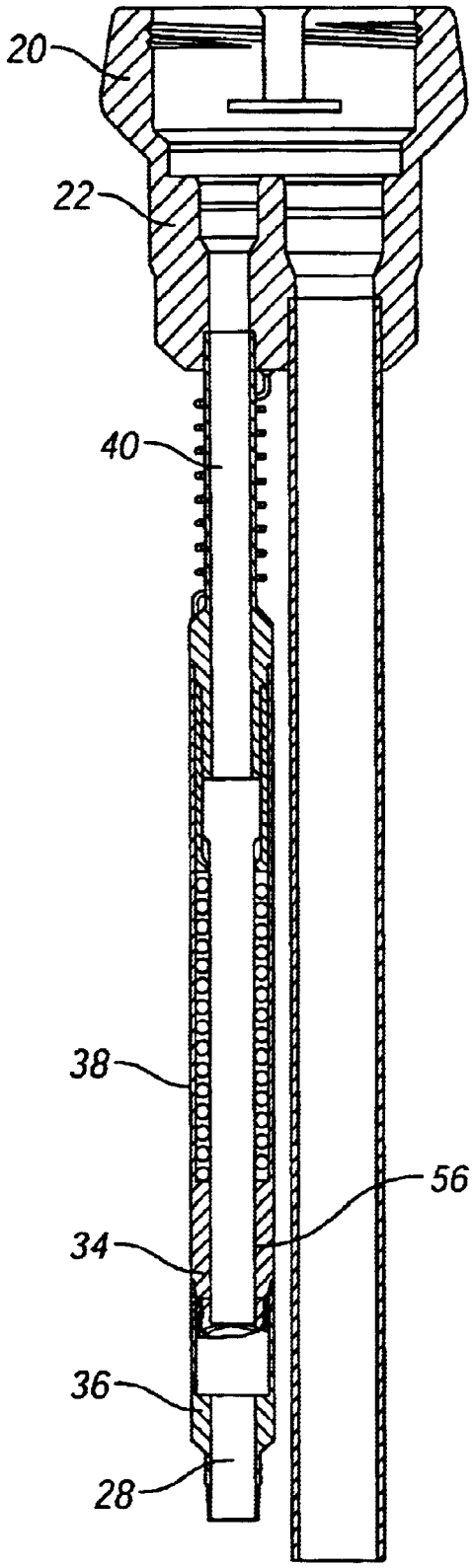
FIG. 2 is a cross section view of the flapper valve installed in the tubing passageway adjacent the wellhead bore.

As shown in FIG. 2, a flapper valve 34 has a flapper valve body 36 preferably consisting of a tubular valve housing 38 which has a flow passage 40. In an alternative embodiment, not shown, this passageway 40 can have two or more flow passageways and two or more flapper valves can be mounted in each passageway in the tubing hanger. It is also within the scope of this invention that if there are two passageways, the sealing member may extend over both of those passageways while the flapper valve is below and outside of the tubing hanger.

It is contemplated as within the scope of the invention that one flapper valve could be mounted so as to provide two valve closure members mounted in a plurality of passageways in the tubing hanger or over a plurality of passageways while the flapper valve is mounted below the tubing hanger in the annulus.

FIG. 3 shows the flapper valve body 36 with a concave spherical segment 44. This concave spherical segment 44 defines an annular valve seat 46, which is concentric to the flow passage 40 for the flapper valve.

Flapper plate 48 is disposed in the valve chamber 23 and provides a rotatable movement from a valve open position in which the flapper plate 48 is removed from annular valve seat 46 to a valve closed position in which the flapper plate 48 extends transversely across the flow passage closing fluid flow in the passage 40.

Figure 4:
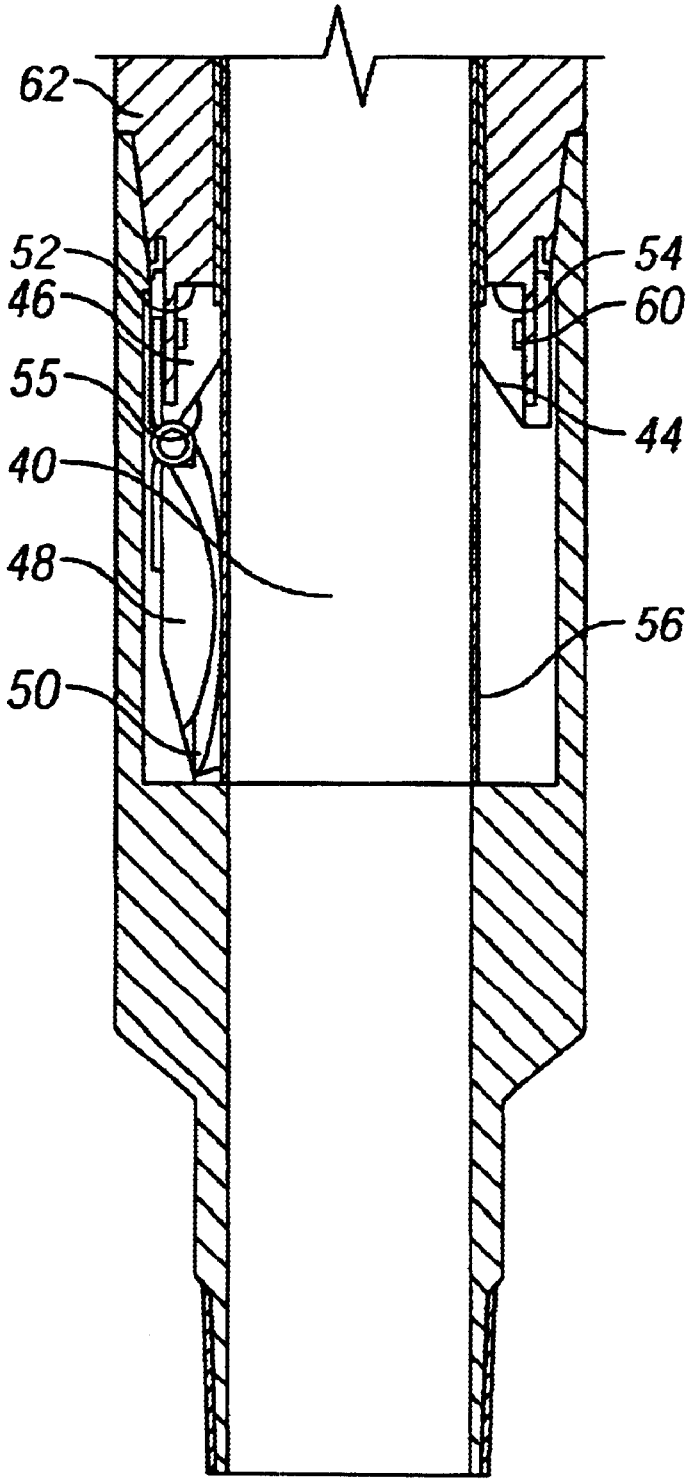
FIG. 4 is a detailed view of a bottom section of a tubing hanger with the flapper valve installed, and with the valve in the open position.

FIG. 4 shows flapper plate 48 preferably having a convex spherical segment 50. This convex spherical segment 50 has a first planar surface 52 and a second planar surface 55. The convex spherical segment 50 is disposed between the first and second planar surfaces 52 and 55.

In the most preferred embodiment, a convex spherical segment 50 is disposed intermediate between first and second planar surfaces 52 and 54. A third peripheral sealing surface 60 can be used to also seal the flapper valve body in the tubing hanger passageway or if the flapper valve is disposed in the annulus, such as in a tube suspended in the annulus and attached to the tubing hanger, the sealing surface 60 can seal the flapper valve body from the annulus as well.

It is contemplated that the flapper valve member, which is valve plate 48, is made from metal for the most environmentally advantageous version of the invention however, it is possible that the flapper plate 48 is made from a laminate, such as a graphite/metal laminate or laminate of other durable materials.

The flapper valve 34 in the most preferred embodiment is operated by hydraulic actuator 56 which can provide pressurized fluid from a remote source, such as a vessel at the surface of the sea. The hydraulic actuator 56 moves the flapper valve components from a closed to an open position. Flapper valves, which can be used within the invention, can be acquired from suppliers, such as Halliburton, Baker Oil Field Tools, Camco or a similar supplier of flapper safety valves, or similar styled safety valves.

In one embodiment of the invention, where the flapper valve is suspended below the tubing hanger, it is contemplated that the flapper valve is disposed within a tube or similar housing suspended from or secured to the tubing hanger by the use of a tubing suspension thread 32.

In FIG. 4 the flapper valve of the present invention is shown in the open position. The flapper plate 48 preferably comprises an annular valve seat 46 having a flapper plate body peripheral sealing surface 60 and a convex spherical segment 50, and a planar surface 54, wherein the convex spherical segment 50 is disposed intermediate between the planar surfaces 44 and 54.

In yet another embodiment, control means 62 is located moveably within the passageway or if the flapper valve is mounted below the tubing hanger, the control means is located adjacent the valve in the annulus. Control means 62 is for controlling the valve closure member 44.

Returning to FIG. 1, a tubular piston 64 can be mounted on the flapper valve 34 for longitudinal extension and retraction of the flapper valve closure 44 of the valve. This tubular piston 64 can be coupled to the control means 62 to extend the piston and close the passageway using the flapper valve closure member 44.

Also shown in FIG. 1, fluid pressure can be injected from a remote source through fluid port 66, such as from a drilling platform or from a drill ship on the sea surface or even from a ROV at some point above the tubing hanger. The hydraulic fluid enters fluid port 66 to hydraulically operate the flapper valve or similar safety valve, such as a ball valve. The pressurized fluid can be alternatively applied to or exhausted from the fluid port 66 in order to move the flapper valve closure member 44 between open and closed positions.

During the installation of the tubing hanger, the tubing hanger running tool is connected to the tubing hanger and provides a vertical hydraulic communication which hydraulically opens the annulus passageway. A controlled loss of hydraulic pressure causes the flapper valve to automatically closes the passageway as a fail safe means. During an emergency failure of a hydraulic line during installation, the passageway would close in a controlled hydraulic shut down.

In the production mode, where the tubing hanger has been landed onto the wellhead and the subsea tree has been installed, the subsea tree provides the same vertical hydraulic communication which opens the passageway.

For the invention to operate it is best understood from FIG. 4 that in the most preferred embodiment the radius of the curvature of the convex spherical segment 50 of the flapper valve must match the radius of curvature of the concave spherical segment of flapper valve closure member 44, and permit nesting engagement of the two segments for sealing engagement.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in a subsea wellhead including a wellhead housing having a wellhead bore therethrough and at least one casing hanger supported within the wellhead bore for suspending at least one casing string within the well head bore, wherein said apparatus comprises:

a. a tubing hanger including a tubing hanger body having an annulus defined between production bore and said casing string therethrough;

b. a flapper valve disposed in said annulus of said tubing hanger adapted for opening and closing the annulus, said flapper valve having a flapper valve closure member with a first segment defining an annular valve seat in said annulus within said tubing hanger;

c. a flapper plate disposed in said valve chamber is adapted for rotatable movement from a valve open position in which said flapper plate is removed from said annular valve seat to a valve closed position in which said flapper plate extends transversely across said annulus and forms a sealing engagement with said annular valve sear thereby preventing flow through said annulus;

d. a sealing surface substantially in the form of a first segment disposed intermediate between a first planar surface and a second planar surface; and e. means responsive to pressurized fluid for hydraulically moving the valve plate from a closed position to an open position.

2. The apparatus of claim 1, wherein said first segment is a concave spherical segment.

3. The apparatus of claim 1, wherein said annular valve seat is concentric with said annulus of said tubing hanger.

4. The apparatus of claim 1, wherein said flapper plate is selected from the group: a plate, and a convex spherical segment.

5. The apparatus of claim 1, wherein said flapper plate comprises a body member having a peripheral sealing surface substantially in the form of a convex spherical segment, wherein the convex spherical segment is deposed intermediate between the first and second planar surfaces of the sealing surface.

6. The apparatus of claim 1, wherein said flapper valve further comprises:

a. control means movably disposed within said tubing hanger for controlling movement of the flapper valve closure member;

b. a tubular piston movably mounted in said flapper valve for longitudinal extension and retraction, said tubular piston being coupled to said control means for extending said tubular piston relative to said control means signals; and c. a fluid port through which pressurized fluid from a remote source above the tubing hanger may be alternately applied to or exhausted from in order to move the flapper valve closure member between the open and closed positions.

7. The apparatus of claim 2, wherein the flapper plate has a spherical convex segment with a radius of curvature matched with the radius of curvature of the first segment to permit nesting engagement of the segments.

8. Apparatus for use in a subsea wellhead having an annulus, further including a wellhead housing having a wellhead bore therethrough and at least one casing hanger supported within the wellhead bore for suspending at least one casing string within the well head bore, wherein said apparatus comprises:

a. a tubing hanger including a tubing hanger body having an annulus defined between production bore and said casing string therethrough;

b. a flapper valve disposed outside of said tubing hanger in said annulus adapted for opening the annulus in said tubing hanger, said flapper valve having a housing connecting said valve to said tubing hanger, a flapper valve closure member substantially in the form of a segment defining an annular valve seat concentric with said tubing for said flapper valve;

c. a flapper plate disposed in said valve chamber is adapted for rotatable movement from a valve open position in which said flapper plate is removed from said annular valve seat to a valve closed position in which said flapper plate extends transversely across said annulus and forms a sealing engagement with said annular valve seat thereby preventing flow through said annulus;

d. a sealing surface having a first segment disposed intermediate between a first and a second planar surface; and e. means responsive to pressurized fluid for hydraulically moving the valve plate from a closed position to an open position.

9. The apparatus of claim 8, wherein said flapper plate comprises a body member having a peripheral sealing surface substantially in the form of a convex spherical segment, and a first and second planar surface, wherein the convex spherical segment is disposed intermediate between the first and second planar surfaces of the sealing surface.

10. The apparatus of claim 8, wherein said first segment is in a concave spherical segment.

11. The apparatus of claim 8, wherein said annular valve seat is concentric to said annulus.

12. The apparatus of claim 8, wherein said flapper plate is a convex spherical segment.

13. The apparatus of claim 8, wherein said flapper valve further comprises:

a. control means movably disposed within said hanger for controlling movement of the valve closure member;

b. a tubular piston movably mounted in said flapper valve for longitudinal extension and reaction, said tubular piston being coupled to said control means for extending said tubular piston relative to said control means signals; and c. a fluid port through which pressurized fluid from a remote source above the tubing hanger may be alternately applied to or exhausted from in order to move the valve closure member between the valve open and closed positions.

14. The apparatus of claim 12, wherein the radius of curvature of the convex spherical segment is matched with the radius of curvature of the first segment, which is concave to permit nesting engagement of the segments.

* * * * *